US006427648B2

(12) United States Patent
Ariga

(10) Patent No.: US 6,427,648 B2
(45) **Date of Patent: *Aug. 6, 2002**

(54) ELECTROMAGNETICALLY-POWERED VALVE OPERATING APPARATUS OF AUTOMOTIVE INTERNAL COMBUSTION ENGINE

(75) Inventor: Kenji Ariga, Kanagawa (JP)

(73) Assignee: Nissan Motor Co., Ltd., Yokohama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/339,943

(22) Filed: Jun. 25, 1999

(30) Foreign Application Priority Data

Jun. 25, 1998 (JP) ..... 10-178976

(51) Int. Cl.[7] ..... F01L 9/04
(52) U.S. Cl. ..... 123/90.11; 251/129.01
(58) Field of Search ..... 123/90.11, 90.27, 123/90.65, 90.67, 184.43, 302, 396, 90.12, 308, 315, 432; 251/129.01, 129.15, 129.16

(56) References Cited

U.S. PATENT DOCUMENTS

| | | | | | |
|---|---|---|---|---|---|
| 4,715,330 | A | * | 12/1987 | Buchl | 123/90.11 |
| 4,715,332 | A | * | 12/1987 | Kreuter | 123/90.11 |
| 5,005,534 | A | * | 4/1991 | Washizu et al. | 123/184.43 |
| 5,072,700 | A | * | 12/1991 | Kawamura et al. | 123/90.11 |
| 5,129,369 | A | * | 7/1992 | Kawamura | 123/90.11 |
| 5,184,582 | A | * | 2/1993 | Okui et al. | 123/90.27 |
| 5,205,259 | A | * | 4/1993 | Clarke et al. | 123/302 |
| 5,448,973 | A | * | 9/1995 | Meyer | 123/90.12 |
| 5,606,949 | A | * | 3/1997 | Ohara et al. | 123/396 |
| 5,669,341 | A | * | 9/1997 | Ushirono et al. | 123/90.11 |
| 5,713,316 | A | * | 2/1998 | Sturman | 123/90.11 |
| 5,799,638 | A | * | 9/1998 | Tsuchida et al. | 123/302 |
| 5,848,578 | A | * | 12/1998 | Uchiyama et al. | 123/90.27 |
| 5,875,746 | A | * | 3/1999 | Izuo | 123/90.11 |
| 5,889,405 | A | * | 3/1999 | Yanai et al. | 123/90.11 |
| 6,024,060 | A | * | 2/2000 | Buehrle, II et al. | 123/90.11 |
| 6,073,596 | A | * | 6/2000 | Kemper | 123/90.11 |
| 6,164,253 | A | * | 12/2000 | Alberter et al. | 123/90.11 |
| 6,202,608 | B1 | * | 3/2001 | Yamaki et al. | 123/90.11 |
| 6,220,210 | B1 | * | 4/2001 | Kobayashi et al. | 123/90.11 |
| 6,298,812 | B1 | * | 10/2001 | Izuo et al. | 123/90.11 |

FOREIGN PATENT DOCUMENTS

| | | | |
|---|---|---|---|
| DE | 3513106 | * | 10/1986 |
| DE | 197 14 496 | | 10/1998 |
| EP | 493 633 | | 7/1992 |
| JP | 61-76713 | * | 4/1986 |
| JP | 61-247807 | | 11/1986 |
| JP | 7-324609 | | 12/1995 |
| JP | 9-256825 | | 9/1997 |
| JP | 9-256826 | * | 9/1997 |
| WO | 95/30104 | | 11/1995 |

* cited by examiner

*Primary Examiner*—Thomas Denion
*Assistant Examiner*—Tu M. Nguyen
(74) *Attorney, Agent, or Firm*—Foley & Lardner

(57) ABSTRACT

An electromagnetically-powered valve operating apparatus has a relatively-small-sized intake valve operating unit as compared to the exhaust valve operating unit. The height of each of the upper and lower coil springs included in the intake valve operating unit is reduced by lowering a spring bias of each of the upper and lower coil springs as compared with the corresponding springs in the exhaust valve operating unit. A coil outside diameter and a coil height of each of the upper and lower electromagnetic coils in the intake-valve operating unit are both reduced by reducing the number of turns of each of the upper and lower coils along with the magnitude of the electromagnetic force created by each of the coils as compared with the corresponding coils of the exhaust valve operating unit.

10 Claims, 5 Drawing Sheets

ELECTROMAGNETICALLY-POWERED VALVE OPERATING APPARATUS OF AUTOMOTIVE INTERNAL COMBUSTION ENGINE

BACKGROUND OF THE INVENTION

1. Field of the Invention

The present invention relates to an electromagnetically-powered valve operating apparatus of an automotive internal combustion engine which is capable of electromagnetically operating intake and exhaust valves.

2. Description of the Prior Art

In recent years, there have been proposed and developed various automotive valve operating apparatus each of which has electromagnetically-operated valve units for electromagnetically opening and closing intake and exhaust valves. Such automotive valve operating apparatus having electromagnetically-operated valve units have been disclosed in Japanese Patent Provisional Publication Nos. 61-247807, 7-324609, and 9-256825.

SUMMARY OF THE INVENTION

Opening and closing actions of an exhaust valve tend to be both affected by residual in-cylinder pressure, still remaining in the combustion chamber when opening the exhaust valve at the end of the combustion stroke and when closing the exhaust valve at the end of the exhaust stroke. On the other hand, only an intake pressure having a comparatively low pressure level acts on an intake valve. From the viewpoint discussed above, the inventor of the invention discovers that it is desirable to downsize only an electromagnetically-operated intake-port valve unit in comparison with an electromagnetically-operated exhaust-port valve unit. Hitherto, a specification (size and type) of an electromagnetically-operated intake-valve unit and a specification of an electromagnetically-operated exhaust-valve unit were identical to each other, thus increasing the total size of an engine cylinder head in a vertical direction of the engine as well as in a direction of its width. As a result, an engine-hood line must be designed to be higher. This reduces design flexibility in a limited space of the engine. Also, the electromagnetically-operated intake-valve unit uses the same large-sized electromagnetic coils as the electromagnetically-operated exhaust-valve unit, thereby resulting in an increase in electric-power consumption.

Accordingly, it is a principal object of the invention to provide a valve-operating apparatus of an automotive internal combustion engine having electromagnetically-operated valve units, which avoids the aforementioned disadvantages of the prior art.

It is another object of the invention to provide a small-sized valve-operating apparatus of an automotive internal combustion engine having electromagnetically-operated valve units, which can compactly design in the vicinity of a cylinder head, and reduce electric-power consumption.

In order to accomplish the aforementioned and other objects of the present invention, an electromagnetically-powered valve operating apparatus of an internal combustion engine of an automotive vehicle, comprises a first valve operating unit adapted to be connected to an intake valve located in a cylinder head, the first valve operating unit comprising a first flanged plunger connected to a valve stem of the intake valve and having a flanged portion, a first pair of electromagnetic coils respectively facing to both faces of the flanged portion of the first flanged plunger, and a first pair of coil springs permanently biasing the valve stem of the intake valve respectively in a direction opening the intake valve and in a direction closing the intake valve, the first pair of coil springs cooperating with the first pair of electromagnetic coils for electromagnetically opening and closing the intake valve by electromagnetic force plus spring bias, a second valve operating unit adapted to be connected to an exhaust valve located in the cylinder head, the second valve operating unit comprising a second flanged plunger connected to a valve stem of the exhaust valve and having a flanged portion, a second pair of electromagnetic coils respectively facing to both faces of the flanged portion of the second flanged plunger, and a second pair of coil springs permanently biasing the valve stem of the exhaust valve respectively in a direction opening the exhaust valve and in a direction closing the exhaust valve, the second pair of coil springs cooperating with the second pair of electromagnetic coils for electromagnetically opening and closing the exhaust valve by electromagnetic force plus spring bias, wherein the first valve operating unit is relatively down-sized in comparison with the second valve operating unit, so that a spring height of each of the first pair of coil springs is set at a smaller value by setting a spring bias of each of the first pair of coil springs at a lower value than each of the second pair of coil springs, and so that a coil outside diameter and a coil height of each of the first pair of electromagnetic coils are both reduced by reducing a number of turns of each of the first pair of electromagnetic coils and by weakening a magnitude of electromagnetic force created by each of the first pair of electromagnetic coils in comparison with each of the second pair of electromagnetic coils.

According to another aspect of the invention, an electromagnetically-powered valve operating apparatus of an internal combustion engine of an automotive vehicle, having an intake valve and an exhaust valve located in a cylinder head so that a valve stem of the intake valve and a valve stem of the exhaust valve are set at an angle, comprises an intake-valve side valve operating unit adapted to be connected to the intake valve, the intake-valve side valve operating unit comprising a first flanged plunger connected to the valve stem of the intake valve and having a flanged portion, a first pair of upper and lower electromagnetic coils respectively facing to both faces of the flanged portion of the first flanged plunger, and a first pair of upper and lower coil springs permanently biasing the valve stem of the intake valve respectively in a direction opening the intake valve and in a direction closing the intake valve, the first pair of upper and lower coil springs cooperating with the first pair of upper and lower electromagnetic coils for electromagnetically opening and closing the intake valve by electromagnetic force plus spring bias, an exhaust-valve side valve operating unit adapted to be connected to the exhaust valve, the exhaust-valve side valve operating unit comprising a second flanged plunger connected to the valve stem of the exhaust valve and having a flanged portion, a second pair of upper and lower electromagnetic coils respectively facing to both faces of the flanged portion of the second flanged plunger, and a second pair of upper and lower coil springs permanently biasing the valve stem of the exhaust valve respectively in a direction opening the exhaust valve and in a direction closing the exhaust valve, the second pair of upper and lower coil springs cooperating with the second pair of upper and lower electromagnetic coils for electromagnetically opening and closing the exhaust valve by electromagnetic force plus spring bias, wherein the first valve operating unit is relatively down-sized in comparison with the second valve operating unit, so that a spring height of each of the first pair of upper and lower coil springs is set at a smaller value by setting a spring bias of each of the first pair of upper and lower coil springs at a lower value than each of the second pair of upper and lower coil springs, and so that a coil outside diameter and a coil height of each of the first pair of upper and lower electromagnetic coils are both reduced by reducing a number of turns of each of the first pair of upper and lower electromagnetic coils and by weakening a magnitude of electromagnetic force created by each of the first pair of upper and lower electromagnetic coils in comparison with each of the second pair of upper and lower electromagnetic coils.

DESCRIPTION OF THE PREFERRED EMBODIMENTS

Figure 1:
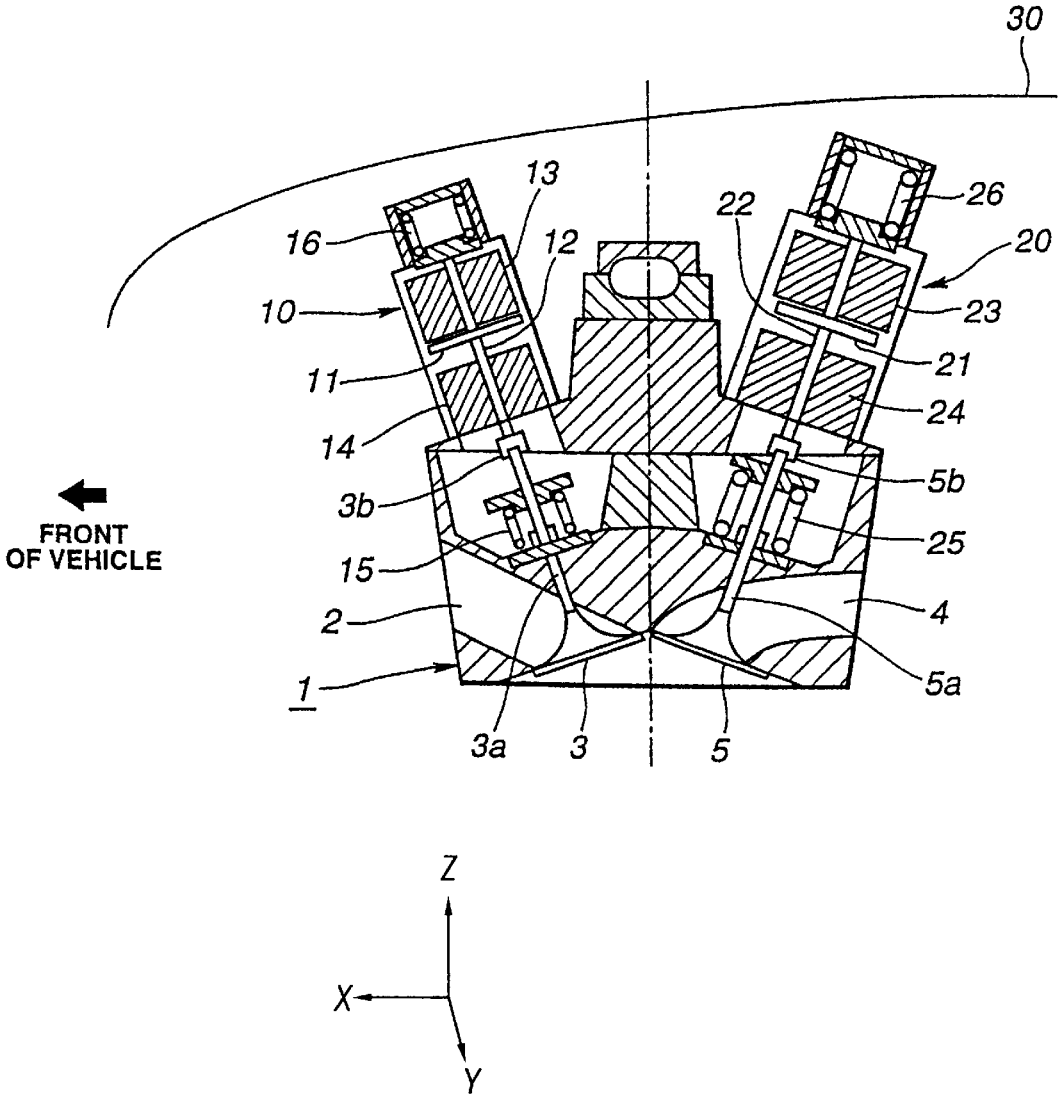
FIG. 1 is a cross-sectional view illustrating a first embodiment of the valve operating apparatus of the invention, combined with an internal combustion engine transversely placed with respect to the x-axis of a vehicle axis system (x, y, z).

Referring now to the drawings, particularly to FIG. 1, the electromagnetically-powered valve operating apparatus of the invention is exemplified in an in-line internal combustion engine transversely mounted with respect to the x-axis of a vehicle axis system (x, y, z). As seen in FIG. 1, a cylinder head denoted by reference sign 1 is formed with an intake-air port (simply an intake port) 2 and an exhaust-air port (simply an exhaust port) 4. An intake valve 3 is located in the cylinder head 1 for opening and closing the intake port 2, while an exhaust valve 5 is located in the cylinder head 1 for opening and closing the exhaust port 4. In the first embodiment shown in FIG. 1, the engine is transversely placed on its engine mounting so that the side of installation of the intake valve 3 is directed in the front of the vehicle, whereas the side of installation of the exhaust valve 5 is directed in the rear of the vehicle. The valve operating apparatus of the first embodiment has an intake-valve side valve operating unit 10 (see the front half of the cylinder head 1) and an exhaust-valve side valve operating unit 20 (see the rear half of the cylinder head 1). The intake-valve side valve operating unit 10 is provided for electromagnetically opening and closing the intake valve 3, while the exhaust-valve side valve operating unit 20 is provided for electromagnetically opening and closing the exhaust valve 5.

The intake-valve side valve operating unit 10 comprises a contact 3*b* fitted onto the valve stem 3*a* of the intake valve 3, a flanged plunger unit 11 having a plunger rod (or a plunger holding rod) 12 whose lower end is in abutted-engagement with the contact 3*b*, upper and lower electromagnetic coils 13 and 14 arranged coaxially around the plunger rod 12 in a manner so as to respectively face to upper and lower flat-faced surfaces of the flanged portion of the flanged plunger unit 11, a lower coil spring unit 15 permanently biasing the valve stem 3*a* in a direction closing the intake valve 3, and an upper coil spring unit 16 permanently biasing the valve stem 3*a* in a direction opening the intake valve 3. The lower coil spring unit 15 comprises a coiled helical compression spring and a spring retainer fixedly connected to the valve stem 3*a* for retaining one end (an upper end) of the coiled helical compression spring. The other end (a lower end) of the coiled helical compression spring of the lower coil spring unit 15 is seated on a spring seat (not numbered) fixed to the cylinder head. On the other hand, the upper coil spring unit 16 is located at the upper end of the intake-valve side valve operating unit 10 in such a manner as to permanently spring-load the upper end of the plunger rod 12 in the opening direction of the intake valve 3. In more detail, the upper coil spring unit 16 comprises a coiled helical compression spring and a spring retainer (not numbered) fixedly connected to the uppermost end of the plunger rod 12 for retaining one end (a lower end) of the coiled helical compression spring, and a cylindrical hollow spring casing (not numbered) serving as a spring seat for the other end (an upper end) of the coiled helical compression spring. When the lower electromagnetic coil 14 of the intake-valve side valve operating unit 10 is activated, the flanged portion of the flanged plunger 11 is attracted downwards in one axial direction of the plunger rod 12 by way of attraction force (electromagnetic force electromagnetically produced) created by the coil 14 energized, with the result that the intake valve 3 is opened. Conversely, when the upper electromagnetic coil 13 of the intake-valve side valve operating unit 10 is activated, the flanged portion of the flanged plunger 11 is attracted upwards in the other axial direction of the plunger rod 12 by way of attraction force created by the coil 13 energized, with the result that the intake valve 3 is closed. The helical compression spring of the lower coil spring unit 15 is provided for holding the closed state of the intake valve 3, whereas the helical compression spring of the upper coil spring unit 16 is provided for holding the opened state of the intake valve 3. The upper electromagnetic coil 13 has the same standard (the same specification, that is, the same number of turns of wire and the nominal size (inside and outside diameters) of wire) as the lower electromagnetic coil 14, while the coiled helical spring of the lower coil spring unit 15 has the same standard (the same specification, that is, the same spring stiffness and the same spring size and dimensions) as that of the upper coil spring unit 16. The electromagnetic coils (13, 14) and the coil spring units (15, 16) cooperate with each other to electromagnetically open and close the intake valve 3 by way of electromagnetic force plus spring bias.

On the other hand, the exhaust-valve side valve operating unit 20 comprises a contact 5*b* fitted onto the valve stem 5*a* of the exhaust valve 5, a flanged plunger unit 21 having a plunger rod (or a plunger holding rod) 22 whose lower end is in abutted-engagement with the contact 5*b*, upper and lower electromagnetic coils 23 and 24 arranged coaxially around the plunger rod 22 in a manner so as to respectively face to upper and lower flat-faced surfaces of the flanged portion of the flanged plunger unit 21, a lower coil spring unit 25 permanently biasing the valve stem 5*a* in a direction closing the exhaust valve 5, and an upper coil spring unit 26 permanently biasing the valve stem 5*a* in a direction opening the exhaust valve 5. The lower coil spring unit 25 comprises a coiled helical compression spring and a spring retainer fixedly connected to the valve stem 5*a* for retaining one end (an upper end) of the coiled helical compression spring. The other end (a lower end) of the coiled helical compression spring of the lower coil spring unit 25 is seated on a spring seat (not numbered) fixed to the cylinder head. The upper coil spring unit 26 is located at the upper end of the exhaust-valve side valve operating unit 20 in such a manner as to permanently spring-load the upper end of the plunger rod 22 in the opening direction of the exhaust valve 5. In more detail, the upper coil spring unit 26 comprises a coiled helical compression spring and a spring retainer (not numbered) fixedly connected to the uppermost end of the plunger rod 22 for retaining one end (a lower end) of the coiled helical compression spring, and a cylindrical hollow spring casing (not numbered) serving as a spring seat for the other end (an upper end) of the coiled helical compression spring. When the lower electromagnetic coil 24 of the exhaust-valve side valve operating unit 20 is activated, the flanged portion of the flanged plunger 21 is attracted downwards in one axial direction of the plunger rod 22 by way of attraction force created by the coil 24 energized, with the result that the exhaust valve 5 is opened. Conversely, when the upper electromagnetic coil 23 of the exhaust-valve side valve operating unit 20 is activated, the flanged portion of the flanged plunger 21 is attracted upwards in the other axial direction of the plunger rod 22 by way of attraction force created by the coil 23 energized, with the result that the exhaust valve 5 is closed. The helical compression spring of the lower coil spring unit 25 is provided for holding the closed state of the exhaust valve 5, whereas the helical compression spring of the upper coil spring unit 26 is provided for holding the opened state of the exhaust valve 5. The upper electromagnetic coil 23 has the same standard (the same specification, that is, the same number of turns of wire and the nominal size (inside and outside diameters) of wire) as the lower electromagnetic coil 24, while the coiled helical spring of the lower coil spring unit 25 has the same standard (the same specification, that is, the same spring stiffness and the same spring size and dimensions) as that of the upper coil spring unit 26. The electromagnetic coils (23, 24) and the coil spring units (25, 26) cooperate with each other to electromagnetically open and close the exhaust valve 5 by way of electromagnetic force plus spring bias.

Figure 5:
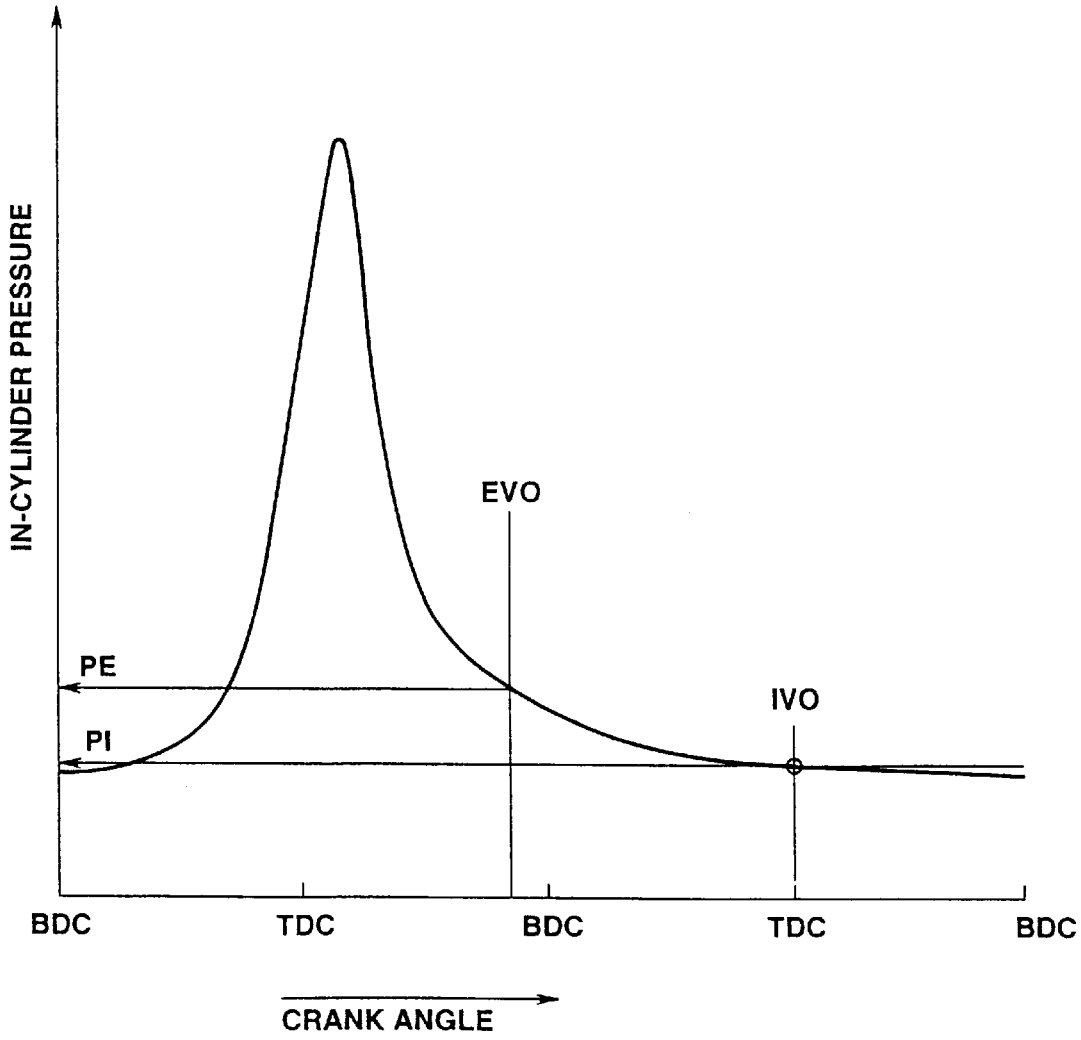
FIG. 5 is a graph illustrating the relationship among an exhaust-valve open timing (EVO), an intake-valve open timing (IVO), and an in-cylinder pressure in the combustion chamber.

Referring now to FIG. 5, there is shown the diagram of in-cylinder pressure plotted against crank angle. In FIG. 5, EVO denotes an exhaust-valve open timing of the exhaust valve 5, IVO denotes an intake-valve open timing of the intake valve 3, PE corresponds to a pressure level of residual pressure, still remaining in the combustion chamber and acting on the valve head of the exhaust valve 5 when opening the exhaust valve 5 at the end of the combustion stroke (before BDC), and PI corresponds to a pressure level of intake pressure acting on the valve head of the intake valve 3 when opening the intake valve 3 at the beginning of the intake stroke (at TDC). As can be appreciated from the graph of FIG. 5, the valve head of the exhaust valve 5 receives the residual pressure PE (having a comparatively high pressure level) remaining in the combustion chamber at the end of the combustion stroke. As discussed above, in order to properly satisfactorily open and close the exhaust valve 5, the coiled helical compression springs of the coil spring units (25, 26) included in the exhaust-valve side valve operating unit 20 must be designed to produce a spring bias enough to overcome the resultant force of the residual in-cylinder pressure PE, a frictional force (the resistance against sliding movement of the plunger rod 22 reciprocating in the inner peripheries of the two electromagnetic coils 23 and 24, and the resistance against reciprocating movement of the valve stem 5*a* of the exhaust valve 5). In order to produce an electromagnetic force substantially corresponding to the magnitude of the spring bias of the coiled helical compression springs of the coil spring units (25, 26), each of the electromagnetic coils 23 and 24 uses a large number of turns. As a consequence, as compared to the intake-valve side valve operating unit 10, the size of the exhaust -valve side valve operating unit 20 is large. On the other hand, the intake valve 3 opens at a time when the residual pressure in the combustion chamber drops and thus the in-cylinder pressure almost reaches the intake pressure PI (intake manifold pressure). In other words, it is possible to open the intake valve 3 by a spring bias slightly greater than a frictional force (the resistance against sliding movement of the plunger rod 12 reciprocating in the inner peripheries of the two electromagnetic coils 13 and 14, and the resistance against reciprocating movement of the valve stem 3*a*). For the reasons set out above,. a spring bias (or a spring stiffness or a spring constant) of each of the coiled helical compression springs of the coil spring units 15 and 16 included in the intake-valve side valve operating unit 10, is designed to be lower than that of each of the coiled helical compression springs of the coil spring units 25 and 26 included in the exhaust-valve side valve operating unit 20. In other words, preload of each of the coil spring units (15, 16) of the intake-valve side valve operating unit 10 is set at a lower level than that of each of the coil spring units (25, 26) of the exhaust-valve side valve operating unit 20, to such an extent that the preload of the intake-valve side coil spring unit overcomes the resistance against sliding movement of the plunger rod 12 reciprocating in the inner peripheries of the two electromagnetic coils 13 and 14, and the resistance against reciprocating movement of the valve stem 3*a*. As a result, under a preload condition where the intake-valve side valve operating unit 10 and the exhaust-valve side valve operating unit 20 are installed on the cylinder head, the axial length (or the spring height) of each of the intake-valve side coil springs (15, 16) is shorter than that of each of the exhaust-valve side coil springs (25, 26). In order to produce an electromagnetic force substantially corresponding to the magnitude of the spring bias of the coiled helical compression springs of the intake-valve side coil spring units (15, 16), each of the electromagnetic coils 13 and 14 uses a small number of turns, thereby producing a relatively reduced electromagnetic force, in comparison with each of the electromagnetic coils 23 and 24 of the exhaust-valve side. The reduced number of turns of each of the coils (13, 14) included in the intake-valve side valve operating unit 10 results in a more reduced electromagnetic-coil height as well as a more reduced electromagnetic-coil outside diameter. As a result of this, the total size (the entire height and the outside diameter) of the intake-valve side valve operating unit 10 is reduced in comparison with that of the exhaust-valve side valve operating unit 20. According to the electromagnetically-powered valve operating apparatus of the first embodiment, when comparing the intake-valve side valve operating unit 10 with the exhaust-valve side valve operating unit 20, the spring height (the axial length) of each of the coiled helical compression springs of the coil spring units (15, 16) is dimensioned to be relatively short, the coil height and the coil diameter of each of the coils (13, 14) are both dimensioned to be relatively small. This enables downsizing of the intake-valve side valve operating unit 10. This permits the surroundings of the cylinder head 1 to be compactly designed. This also enhances design flexibility in engine-mounting (the degree of freedom in engine lay-out). Additionally, each of the electromagnetic coils 13 and 14 is small-sized in due consideration of the relatively reduced size (the reduced spring bias or the reduced spring stiffness) of each of the coil spring (15, 16), such that its electromagnetic force is lowered or weakened as compared to the respective coil (23, 24) included in the exhaust-valve side valve operating unit 20. This reduces electric-power consumption. In the first embodiment, the electromagnetically-powered valve operating apparatus of the invention is applied to a case of an internal combustion engine transversely mounted, in which the relatively-small-sized intake-valve side valve operating unit 10 faces to the front of the vehicle and the relatively-large-sized exhaust-valve side valve operating unit 20 faces to the rear of the vehicle. The height from the ground to the uppermost end of the front half of the cylinder head, which uppermost end is determined by the tip of the intake-valve side valve operating unit 10, is somewhat lowered as compared to the height from the ground to the uppermost end of the rear half of the cylinder head. This facilitates a slanted nose of the vehicle (see the slanted hood line of an engine hood 30 of the transversely-mounted engine shown in FIG. 1), and also enlarges the degree of freedom of modeling of the front portion of the vehicle body. The layout of the electromagnetically-powered valve operating apparatus of the first embodiment (with the relatively-small-sized intake-valve side valve operating unit 10 facing to the front of the vehicle and the relatively-large-sized exhaust-valve side valve operating unit 20 facing to the rear of the vehicle), as seen in FIG. 1, is useful to a particular case where the engine is transversely mounted in an upright state shown in FIG. 1 or in a backwardly-slanted state (not shown). In other words, the layout of the valve operating apparatus of the first embodiment is useful for a particular case that the engine is transversely mounted in the upright state so that the engine centerline (indicated by one-dotted line in FIG. 1) of the internal combustion engine is substantially parallel to the z-axis of the vehicle axis system (x, y, z). The layout of the valve operating apparatus of the first embodiment is also useful for a particular case that the engine is transversely mounted in the backwardly-slanted state so that the engine centerline of the internal combustion engine is inclined backwards from the z-axis of the vehicle axis system (x, y, z).

Figure 2:
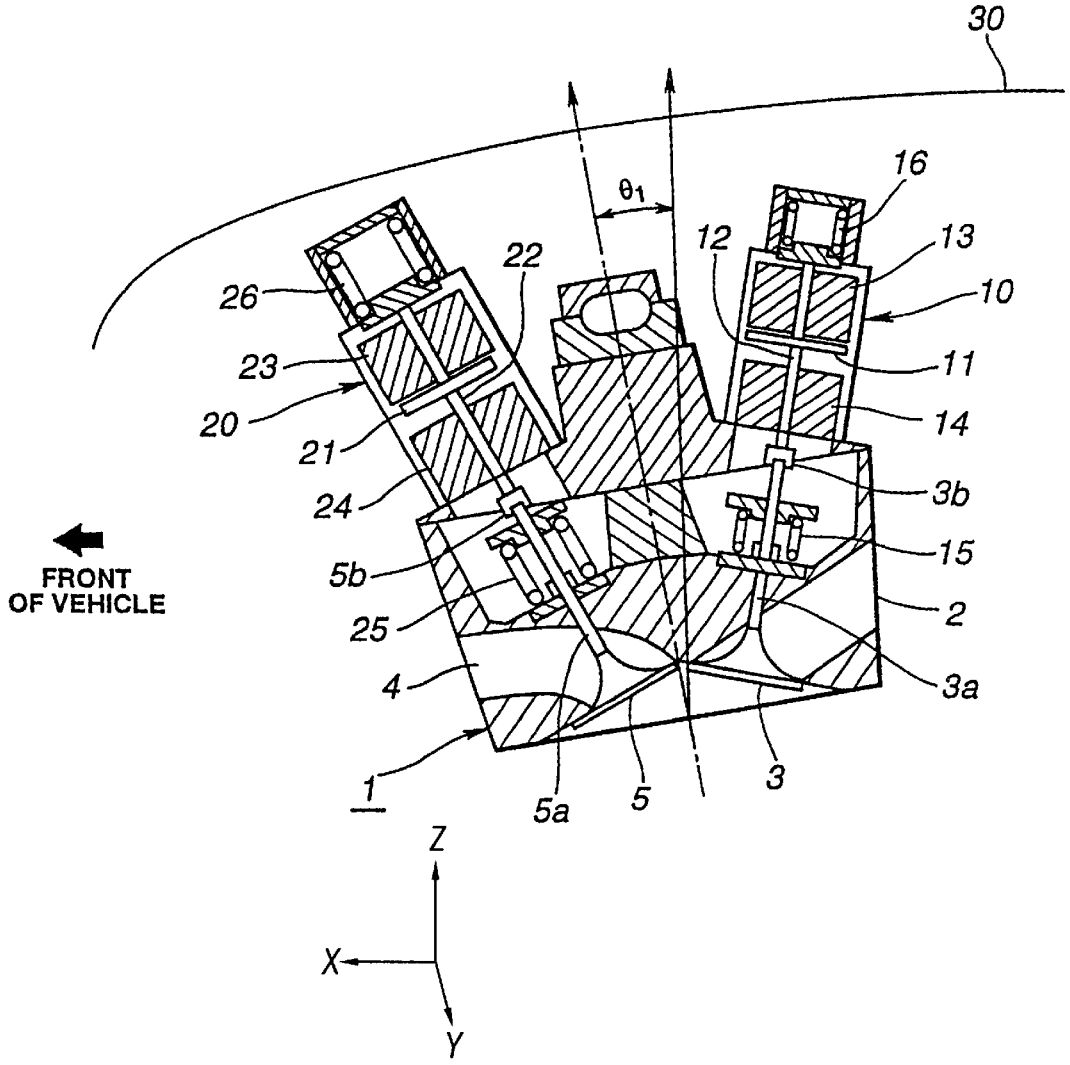
FIG. 2 is a cross-sectional view illustrating a second embodiment of the valve operating apparatus of the invention, combined with an internal combustion engine transversely placed with respect to the x-axis of the vehicle axis system (x, y, z), and slanted to the front side.

Referring now to FIG. 2, there is shown the second embodiment of the electromagnetically-powered valve operating apparatus in combination with an in-line internal combustion engine transversely mounted with respect to the x-axis of the vehicle axis system (x, y, z). In contrast to the electromagnetically-powered valve operating apparatus of the first embodiment (FIG. 1), in the electromagnetically-powered valve operating apparatus of the second embodiment the relatively-small-sized intake-valve side valve operating unit 10 is installed on the rear half of the cylinder head 1 so that the intake-valve side valve operating unit 10 faces to the rear of the vehicle, whereas the relatively-large-sized exhaust-valve side valve operating unit 20 is installed on the front half of the cylinder head 1 so that the exhaust-valve side valve operating unit 20 faces to the front of the vehicle. As shown in FIG. 2, the engine is slanted forwards by a forwardly-slanted angle θ1. In the second embodiment, the relatively-small-sized intake-valve side valve operating units 10 are mounted transversely with respect to the x-axis of the vehicle axis system (x, y, z) and placed on the rear half of the cylinder head 1, and thus it is possible to straighten an intake manifold (not shown). This facilitates the layout of the induction system, and also reduces the resistance against mass flow of induced fresh air, thus enhancing the engine performance (particularly engine power output). In case of the electromagnetically-power valve operating apparatus of the second embodiment shown in FIG. 2, the relatively-large-sized exhaust-valve side valve operating unit 20 is transversely placed on the front half of the cylinder head 1 in such a manner as to face to the front of the vehicle, but, the engine is slanted forwards by the slant angle θ1. The forwardly-slanted engine design contributes to reduction in the height from the ground to the uppermost end of the front half of the cylinder head (i.e., the height from the ground to the hood line), thus permitting the slant-nose design. Additionally, The forwardly-slanted engine design reduces the height from the ground to an exhaust manifold (not shown) of the transversely-placed engine. This decreases the length of the exhaust system between the exhaust manifold and an exhaust emission control device (not shown), thereby enhancing temperature-rise characteristics of the exhaust emission control device, and consequently improving the exhaust emission performance.

Figure 3:
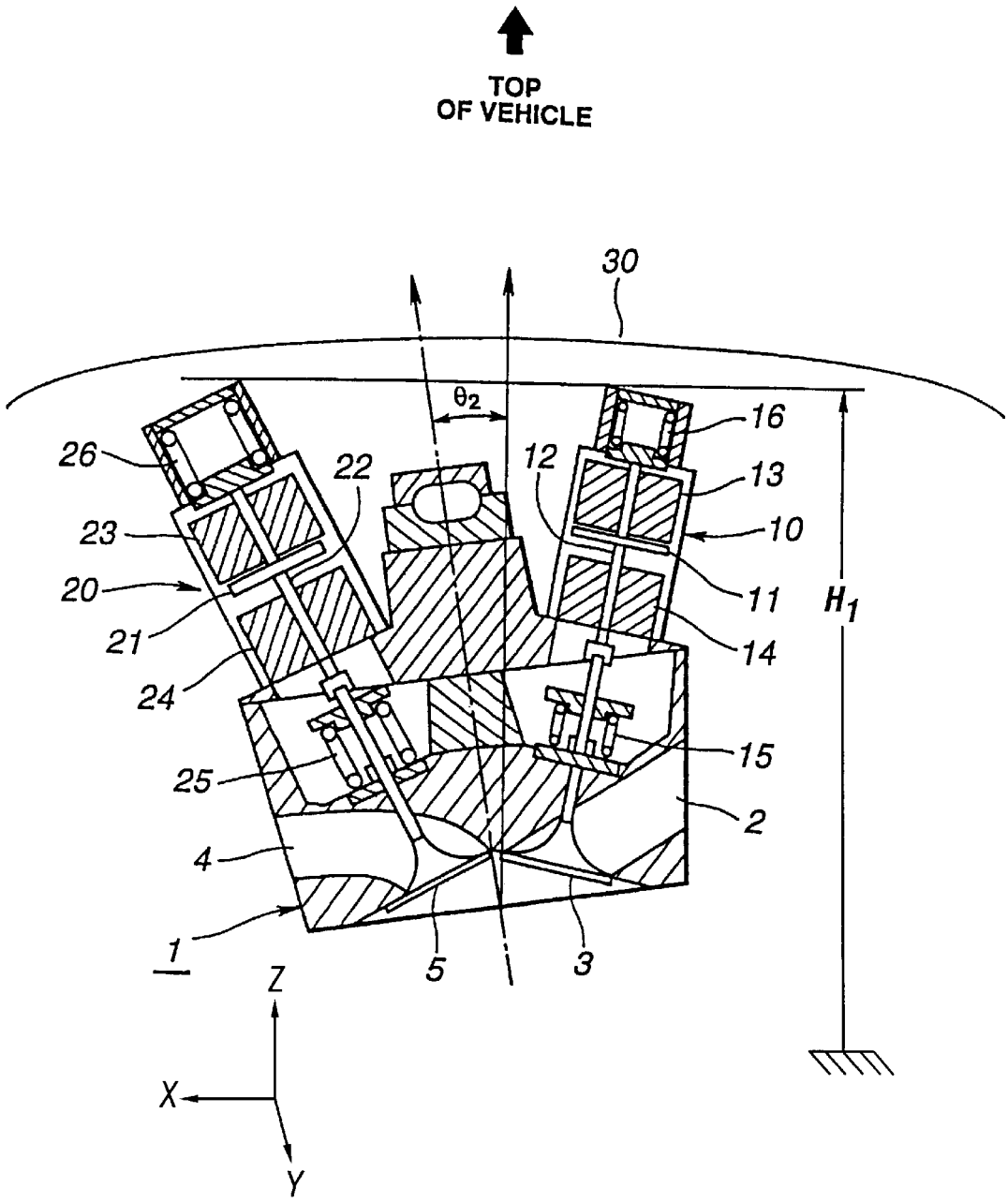
FIG. 3 is a cross-sectional view illustrating a third embodiment of the valve operating apparatus of the invention, combined with an internal combustion engine longitudinally placed with respect to the y-axis of the vehicle axis system (x, y, z), and slanted to one side of the vehicle.

Referring now to FIG. 3, there is shown the third embodiment of the electromagnetically-powered valve operating apparatus in combination with an in-line internal combustion engine longitudinally mounted with respect to the y-axis of the vehicle axis system (x, y, z). As seen in FIG. 3, in the electromagnetically-powered valve operating apparatus of the third embodiment, the engine is slanted to one side (that is, a side of installation of the exhaust valve 5) by a transversely-slanted angle $\theta_2$, so that the height ($H_1$) from the ground to the uppermost end of the relatively-large-sized exhaust-valve side valve operating unit 20 is substantially equal to the height ($H_1$) from the ground to the uppermost end of the relatively-small-sized intake-valve side valve operating unit 10. Even in case that the valve operating apparatus of the invention is applied to the longitudinally-placed engine, the previously-discussed transversely-slanted engine layout (of the transversely-slanted angle $\theta_2$,) contributes to reduction in the total height $H_1$ of the cylinder head 1 from the ground. This enlarges the degree of freedom of modeling of the front portion (containing the engine hood 30) of the vehicle body.

Figure 4:
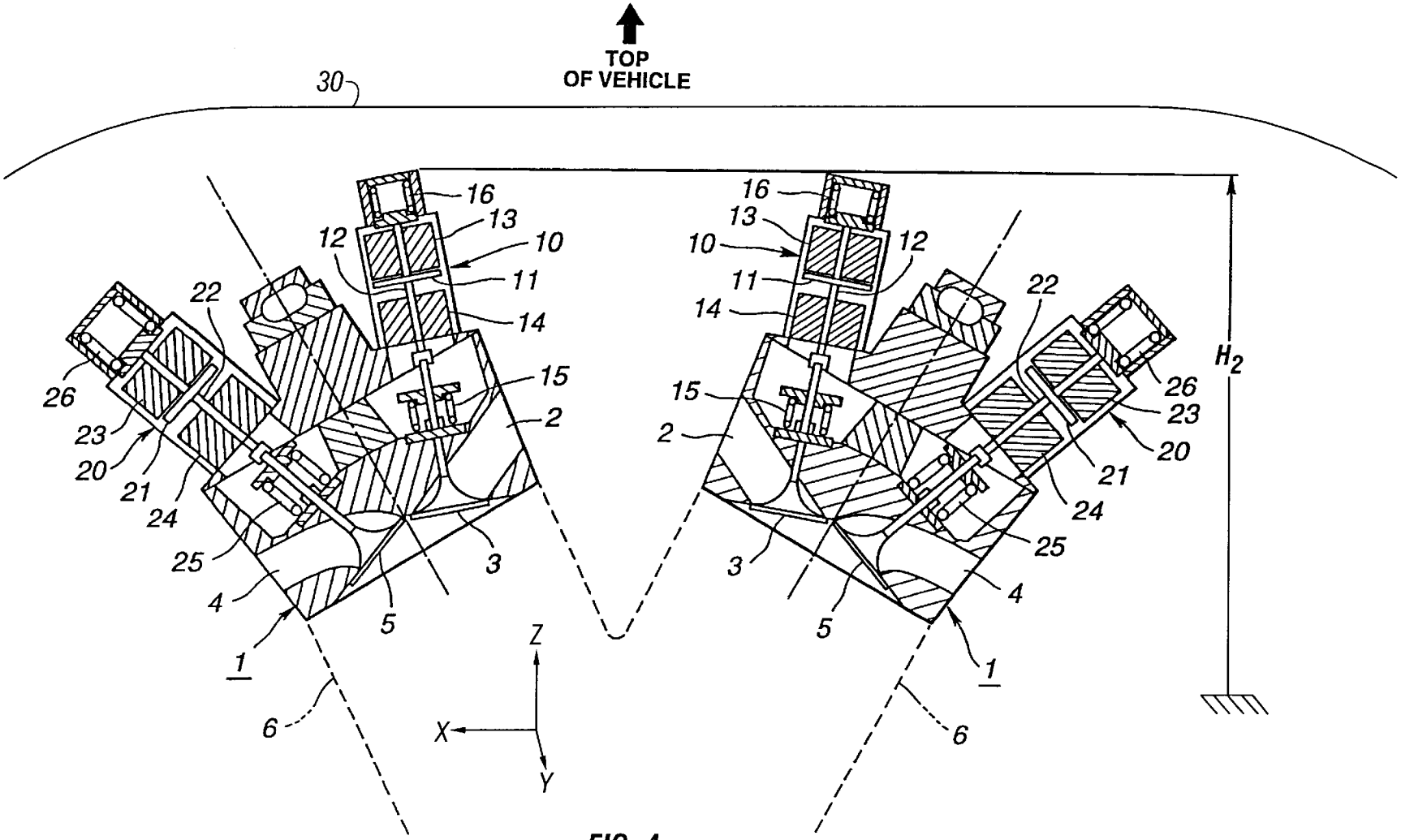
FIG. 4 is a cross-sectional view illustrating a fourth embodiment of the valve operating apparatus of the invention, combined with a V-type internal combustion engine longitudinally placed with respect to the y-axis of a vehicle axis system (x, y, z).

Referring to FIG. 4, there is shown the fourth embodiment of the electromagnetically-powered valve operating apparatus in combination with a V-type internal combustion engine longitudinally mounted with respect to the y-axis of the vehicle axis system (x, y, z) and having engine cylinders arranged in two banks set at an angle (see two cylinder blocks (6, 6) shown in FIG. 4). In the valve operating apparatus of the fourth embodiment, the relatively-small-sized intake-valve side valve operating units (10, 10) installed on the two cylinder heads (1, 1) are located at the inside of the V-type engine (that is, the inside halves of the two cylinder heads, these inside halves facing to each other), while the relatively-large-sized exhaust-valve side valve operating units (20, 20) installed on the two cylinder heads (1, 1) are located at the outside of the V-type engine (that is, the outside halves of the two cylinder heads, these outside halves facing apart from each other). As clearly seen in FIG. 4, in the fourth embodiment, the relatively-small-sized intake-valve side valve operating units (10, 10) are mounted on the respective inside halves of the two cylinder heads (1, 1) set at the V type. With this arrangement, the induction system can be easily located or concentrated in the vicinity of the center of the V-type engine. This facilitates the layout of the induction system. Additionally, the height from the ground to the uppermost end of each of the relatively-small-sized intake-valve side valve operating units (10, 10) corresponds to the total height $H_2$ of the cylinder heads (1, 1) from the ground, thereby effectively reducing the height $H_2$ Of the cylinder heads (1, 1). This enlarges the degree of freedom of modeling of the front portion (containing the engine hood 30) of the vehicle body and enhances design flexibility. In the embodiment shown in FIG. 4, although the relatively-small-sized intake-valve side valve operating units (10, 10) are arranged inside of the V layout, the relatively-large-sized exhaust-valve side valve operating units (20, 20) may be arranged inside of the V layout, while arranging the relatively-small-sized intake-valve side valve operating units (10, 10) at the outside of the V-type engine. In this modification, there is a tendency for the height $H_2$ from the ground to the tip ends of the cylinder heads (1, 1) to be somewhat high in comparison with the example shown in FIG. 4. In lieu thereof, the modification has the merit of reduced entire width of the V-type engine.

The entire contents of Japanese Patent Application No. P10-178976 (filed Jun. 25, 1998) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. An internal combustion engine comprising:

a first type of poppet valve operatively associated with an induction system of the engine;

a second type of poppet valve operatively associated with an exhaust system of the engine;

a first type of electromagnetically powered valve operating unit associated with each and every of the first type of poppet valve; and a second type of electromagnetically powered valve operating unit associated with each and every of the second type of poppet valve;

wherein the height of the first type of electromagnetically powered valve operating unit taken in an axial direction of the first type of poppet valve is less than the height of the second type of electromagnetically powered valve operating unit.

2. An engine mounted to a vehicle and covered with an engine hood of the vehicle, comprising:

at least one exhaust valve operating unit operatively connected to an exhaust valve and disposed on an exhaust side of a cylinder head relative to a cylinder head centerline, the exhaust valve operating unit including an exhaust electromagnetic coil and an exhaust spring, the exhaust electromagnetic coil and the exhaust spring being arranged to cooperate with each other to electromagnetically open and close the exhaust valve; and at least one intake valve operating unit operatively connected to an intake valve and disposed on an intake side of the cylinder head relative to the cylinder head centerline, the intake valve operating unit including an intake electromagnetic coil and an intake spring, the intake electromagnetic coil and the intake spring being arranged to cooperate with each other to electromagnetically open and close the intake valve, wherein a maximum operating unit height of each and every intake valve operating unit of said engine is smaller than that of each and every exhaust valve operating unit such that a maximum cylinder head height at the intake side is relatively smaller than that at the exhaust side, wherein a spring bias of the intake spring is lower than that of the exhaust spring, and an electromagnetic force of the intake electromagnetic coil is lower than that of the exhaust electromagnetic coil.

3. An engine as claimed in claim 2, wherein the engine is transversely mounted on the vehicle with respect to a x-axis of a vehicle axis system (x, y, z) and slants toward the front of the vehicle, so that the intake valve operating unit faces the rear of the vehicle and the exhaust valve operating unit faces the front of the vehicle.

4. An engine as claimed in claim 2, wherein the engine is longitudinally mounted in the vehicle with respect to an x-axis of a vehicle axis system (x, y, z) and slants toward an exhaust valve operating unit side of the vehicle.

5. An engine as claimed in claim 2, wherein the engine is a V-type engine having two cylinder heads respectively arranged in two banks, and wherein the intake valve operating unit is installed on inside halves of the cylinder heads, and the exhaust valve operating unit is installed on outside halves of the cylinder heads, the inside halves face to each other.

6. An engine as claimed in claim 2, wherein a coil outside diameter of the intake electromagnetic coil is smaller than that of the exhaust electromagnetic coil.

7. An engine as claimed in claim 2, wherein the engine and the engine hood are mounted such that the engine hood slants toward the front of the vehicle.

8. An engine as claimed in claim 2, wherein the engine is transversely mounted on the vehicle with respect to a x-axis of a vehicle axis system (x, y, z), so that the intake valve operating unit faces the front of the vehicle and the exhaust valve operating unit faces the rear of the vehicle.

9. An engine as claimed in claim 8, wherein the engine is in an upright state, so that an engine centerline of the engine is substantially parallel to a z-axis of the vehicle axis system (x, y, z).

10. An engine as claimed in claim 8, wherein the engine is in a backwardly-slanted state, so that an engine centerline of the engine is inclined backwards from a z-axis of the vehicle axis system (x, y, z).

* * * * *